US005601067A

United States Patent [19]

Wirbeleit et al.

[11] Patent Number: 5,601,067

[45] Date of Patent: Feb. 11, 1997

[54] FUEL INJECTION SYSTEM FOR AN INTERNAL COMBUSTION ENGINE

[75] Inventors: Friedrich Wirbeleit; Wolfgang Lehner, both of Esslingen; Alois Raab, Aalen, all of Germany

[73] Assignee: Daimler-Benz AG, Stuttgart, Germany

[21] Appl. No.: 495,185

[22] Filed: Jun. 27, 1995

[30] Foreign Application Priority Data

Jun. 28, 1994 [DE] Germany ..... 44 22 552.0

[51] Int. Cl.[6] ..... F02B 13/00; F02B 3/00

[52] U.S. Cl. ..... 123/575; 123/300; 123/25 E; 123/446

[58] Field of Search ..... 123/299, 300, 123/446, 575, 576, 577, 578, 25 R, 25 A, 25 E

[56] References Cited

U.S. PATENT DOCUMENTS

| | | | |
|---|---|---|---|
| 3,749,097 | 7/1973 | Grow | 123/25 E |
| 3,921,599 | 11/1975 | Grow | 123/25 E |
| 4,481,921 | 11/1984 | Tsukahara | 123/575 |
| 4,674,448 | 6/1987 | Steiger | 123/446 |
| 4,693,227 | 9/1987 | Satou | 123/300 |
| 4,705,010 | 11/1987 | Baranescu | 123/575 |
| 5,174,247 | 12/1992 | Tosa | 123/25 E |
| 5,245,953 | 9/1993 | Shimada et al. | 123/575 |
| 5,315,973 | 5/1994 | Hill | 123/299 |
| 5,404,855 | 4/1995 | Yen | 123/446 |
| 5,421,710 | 6/1995 | Yorita | 123/300 |

FOREIGN PATENT DOCUMENTS

| | | | |
|---|---|---|---|
| 0282819 | 9/1988 | European Pat. Off. . | |
| 0610584 | 8/1994 | European Pat. Off. . | |
| 2252307 | 3/1973 | Germany . | |
| 3724987 | 2/1988 | Germany . | |
| 3929115 | 3/1991 | Germany . | |
| 60-5924 | 7/1986 | Japan . | |
| 6101589 | 4/1994 | Japan | 123/25 R |
| 2126650 | 3/1984 | United Kingdom . | |
| 2283282 | 5/1995 | United Kingdom . | |

*Primary Examiner*—Carl S. Miller
*Attorney, Agent, or Firm*—Klaus J. Bach

[57] ABSTRACT

In a fuel injection system for injecting fuel into a combustion chamber of an internal combustion engine by means of a dual fluid injector which includes a nozzle with a nozzle needle normally closing the nozzle and which has formed around the nozzle needle an annular space which is in communication with a fluid source and a pressure chamber in communication with the annular space and the working space of a plunger disposed in the injector so as to be movable between upper and lower end positions but being biased to its upper end position, the plunger working space is in communication with a fuel source via a fuel supply line which includes a control valve and an electromagnetically controlled valve is provided for controlling the admission of a hydraulic operating fluid to the plunger for moving the plunger into the working space for the ejection of the fuel and the fluid from the pressure chamber and the annular space around the nozzle and the fuel supply line includes an electronically controllable valve adapted to close the fuel supply line for a controllable period of time while the plunger is returned to its upper end position to thereby create a vacuum in the working space for drawing an amount of the fluid into the annular space around the nozzle which depends on the time for which the fuel supply line is closed by the control valve.

6 Claims, 1 Drawing Sheet

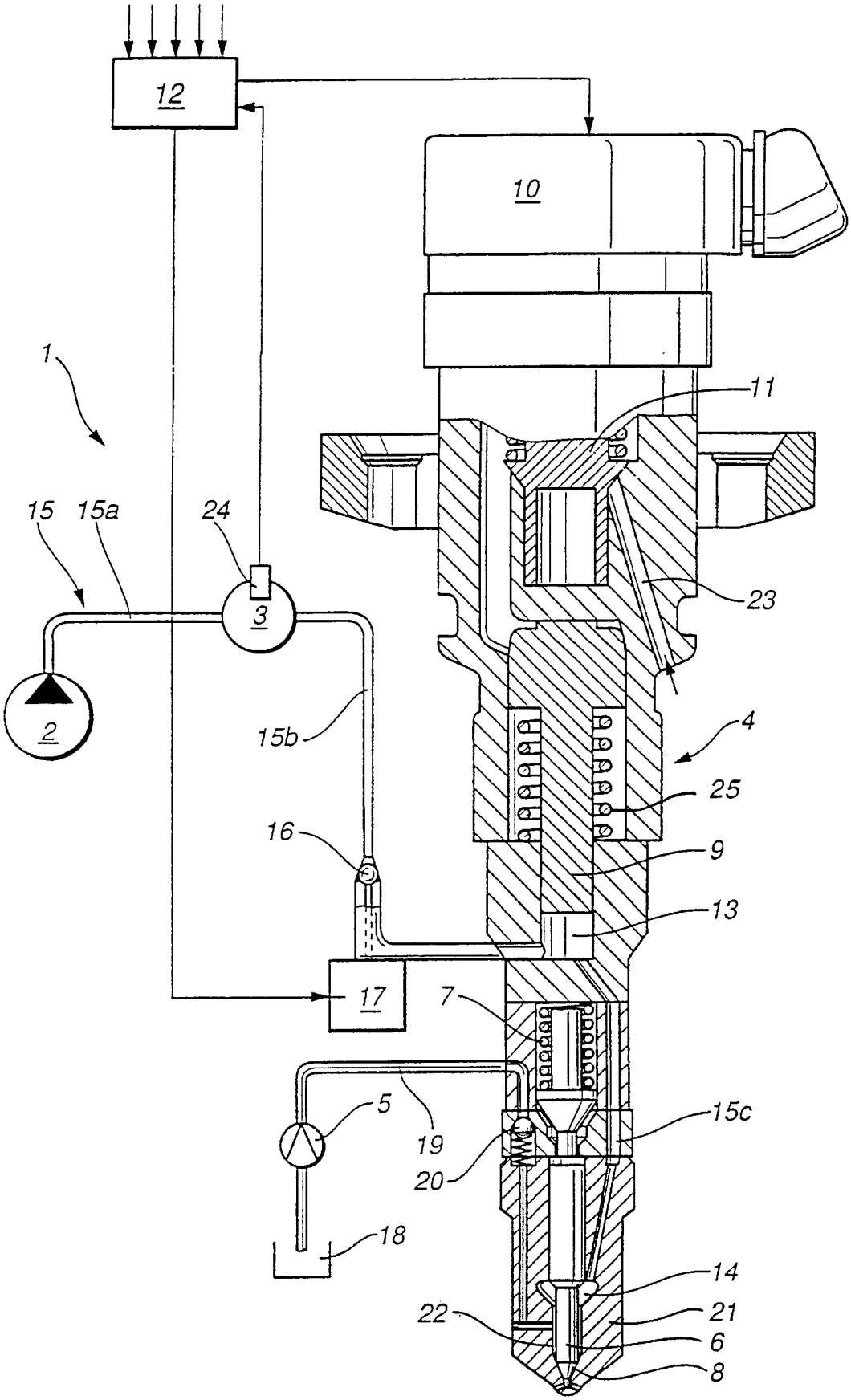
12
10
1
11
15
15a
24
3
23
2
15b
4
25
16
9
13
17
7
5
15c
19
20
18
14
22
21
6
8

FUEL INJECTION SYSTEM FOR AN INTERNAL COMBUSTION ENGINE

BACKGROUND OF THE INVENTION

The invention relates to a fuel injection system for an internal combustion engine with a fuel pump for supplying the fuel to a dual-fluid injector.

German Offenlegungsschrift DE-A 22 52 307 discloses a fuel injection system in which the fuel pump is a cam-operated injection pump which supplies fuel, at high pressure, to a dual-fluid injector in which water is introduced as an additional fluid. As soon as the fuel reaches the opening pressure of the nozzle needle of the dual-fluid injector, fuel and water are injected into the engine. Water is again introduced into the injector at a time when the pressure in the fuel supply line leading to the dual-fluid injector drops as a result of the return movement of the nonreturn valve disposed therein. As a result of the pressure drop, a specific quantity of water is sucked out of a water tank via a nonreturn valve into the fuel supply line and is mixed with the fuel therein for the next injection step. In the water-conducting supply line a shut-off or control valve is provided which opens or closes as a function of operating parameters of the internal combustion engine.

In this fuel injection system a quantity-controlling high-pressure piston injection pump is assigned to each dual-fluid injector.

It is the object of the present invention to provide a fuel injection system which permits the use of a simple feed pump and a simple structure for the introduction of the additional fluid. In addition, fuel should be supplied to a plurality of dual-fluid injectors utilizing only a single fuel pump.

SUMMARY OF THE INVENTION

In a fuel injection system for injecting fuel into a combustion chamber of an internal combustion engine by means of a dual fluid injector which includes a nozzle with a nozzle needle normally closing the nozzle and which has formed around the nozzle needle an annular space which is in communication with a fluid source and a pressure chamber in communication with the annular space and the working space of a plunger disposed in the injector so as to be movable between upper and lower end positions but being biased to its upper end position, the plunger working space is in communication with a fuel source via a fuel supply line, and an electromagnetically controlled valve is provided for controlling the admission of a hydraulic operating fluid to the plunger for moving the plunger into the working space for the ejection of the fuel and the fluid from the pressure chamber and the annular space around the nozzle, and the fuel supply line includes an electronically controllable valve adapted to close the fuel supply line for a controllable period of time while the plunger is returned to its upper end position to thereby create a vacuum in the working space for drawing an amount of the fluid into the annular space around the nozzle which depends on the time for which the fuel supply line is closed by the control valve.

By providing a control valve which, at the same time, is a nonreturn valve, a saving in space as well as a reduced constructional outlay is obtained. As a result of using one uncontrolled fuel pump which only provides a certain low fuel supply pressure and which is particularly suitable for low-pressure common-rail systems and thus for supplying fuel to a plurality of dual-fluid injectors, sealing problems in the line arrangements or connections are avoided. The necessary high injection pressure is produced by the pressure-intensifying plunger accommodated in the dual-fluid injector. The function of feeding the additional fluid is performed by a low-power feed pump which only has to generate a feed pressure below the already low supply pressure of the fuel pump.

An exemplary embodiment of the invention is illustrated and described below in greater detail with reference to the enclosed figure.

BRIEF DESCRIPTION OF THE DRAWING

The sole FIGURE shows the fuel injection arrangement according to the invention.

DESCRIPTION OF THE PREFERRED EMBODIMENT

As shown in the Figure a fuel injection system 1, which is a dual-fluid system for diesel internal combustion engines, comprises a fuel pump 2 which supplies diesel fuel, via a common supply line 3 (common rail) to solenoid valve-controlled dual-fluid injectors 4 and a low-power feed pump 5 which feeds an additional fluid to the injectors 4. Water is provided here as the additional fluid.

The dual-fluid injector 4 includes a nozzle needle 6 which is lifted off its valve seat 8 against the force of a spring 7 in a direction opposite to the direction of the flow of fuel when the fuel reaches opening pressure, a spring-loaded pressure-intensifying plunger 9 and a spring-loaded valve 11 which can be operated by an electromagnet 10 which is energized by an electronic control unit 12 depending on engine operating parameters including for example the fuel pressure as sensed by a sensor 24 in the common fuel supply line 3 and which controls the admission of high-pressure oil from a high pressure oil circuit to the pressure-intensifying plunger 9.

The pressure-intensifying plunger 9 is biased into an upper end position by a spring 25 and defines, at its lower end, a working space 13 which is in communication with a fuel supply line 15 which extends from the fuel pump 2 to a pressure chamber 14 surrounding the nozzle needle 6.

The fuel supply line 15 is divided into a feed line **15*a* which connects the fuel pump 2 to the supply line 3, a control line 15*b* which contains a control valve 16 and which connects the supply line 3 to the working space 13 of the dual-fluid injector 4, and finally a high-pressure passage 15*c* which provides for communication between the working space 13 and the pressure chamber 14**.

The control valve 16 which is a controllable nonreturn valve is adapted to close the control line **15*b* in the direction opposite to the flow of fuel, the control valve 16 being operated by means of an actuator 17. The actuator 17 can be designed as an electromagnet or a piezoelectric element and is controlled by the electronic control unit 12**.

Water is supplied by the feed pump 5 which sucks water out of a tank 18 and feeds it through a supply line 19 via a nonreturn valve 20 into an annular space 22, formed by the nozzle needle 6 and nozzle body 21, below the pressure chamber 14.

Operation of the dual-fluid system as a low-pressure common-rail system with the pressure-intensifying plunger is as follows:

Water is introduced into the annular space 22 during the return movement of the pressure-intensifying plunger 9 when the pressure thereon is relieved. During the return movement of the pressure-intensifying plunger 9 the control valve 16 is kept closed using the actuator 17, so that a partial vacuum is generated in the working space 13 and also in the annular space 22 which causes water present in the feed line 19 at a pressure of approximately 2 bar to be sucked, via the nonreturn valve 20, into the annular space 22 of the nozzle body 21.

Opening of the control valve 16 terminates introduction of water since, then the fuel supplied by the fuel pump 2 fills the working space 13 and eliminates the partial vacuum maintained therein.

The fuel supply pressure of approximately 3 bar is higher than the water supply pressure in order to ensure that, upon opening of the control valve 16, fuel flows immediately into the working space 13 and the introduction of water is terminated. The quantity of water introduced into the fuel can consequently be controlled by the actuator 17.

The high fuel injection pressure which is needed at the nozzle needle 6 is generated by a separate oil circuit which is not illustrated in detail but by which the pressure-intensifying plunger 9 in the respective dual-fluid injector is operated. The pressure-intensifying plunger 9 forms within the housing 4 a piston with a relatively large diameter to which pressurized oil is supplied via an oil line 23, connected to the oil circuit and opened by means of a valve 11 actuated by the electromagnet 10. When the valve 11 is opened the plunger 9 is moved against the force of the spring 25 so that the fluid volume located in the working space 13 is expelled with high pressure. As the control valve 16 closes, the pressure in the working space 13 rises to the nozzle needle opening pressure whereby the nozzle needle 6 is lifted against the force of spring 7 thereby permitting the ejection of fuel and water from the injector 4.

The ejection is ended when the valve 11 is in the original closed position and the rear of the pressure-intensifying plunger 9 is in communication with a non-pressurized oil return line (not illustrated) providing a relief of pressure.

What is claimed is:

1. A fuel injection system for injecting fuel under pressure into a combustion chamber of an internal combustion engine, said system comprising: a dual fuel injector having a housing defining at one end thereof a fuel injection nozzle and a nozzle needle movably disposed in said housing and normally closing said injection nozzle, said housing defining around said nozzle needle an annular space in communication with a fluid source and a pressure chamber in communication with said annular space, a pressure-intensifying plunger arranged so as to be movable into and out of a working space which is in communication with said pressure chamber and with a fuel supply line, a control valve disposed in said fuel supply line for controlling admission of fuel to said working space, an electromagnetic valve-controlled pressurized hydraulic operating fluid supply for moving said plunger into said working space to pressurize fuel therein and also in said pressure chamber whereby said nozzle needle is lifted and the fluid in said annular space is ejected from said nozzle together with the fuel from said pressure chamber, and a control unit for controlling said electromagnetic valve and said fuel line control valve so as to close said fuel supply line for a controlled period of time while said plunger is moving out of said working space thereby generating in said working space a vacuum for drawing an amount of fluid into said annular space around said nozzle which depends on the time period for which said fuel line is closed by said control valve.

2. A system according to claim 1, wherein said internal combustion engine is a Diesel engine and said time period during which said fuel supply line is blocked by said control valve is dependent on operating parameters of said Diesel engine.

3. A system according to claim 1, wherein a fuel pump is provided for maintaining said fuel under a predetermined fuel pressure and said pressure-intensifying plunger is adapted to provide a fuel pressure which is significantly higher than the pressure generated by said fuel pump.

4. A system according to claim 1, wherein said fluid is water.

5. A system according to claim 1, wherein said plunger and said working space are arranged within said injector housing and said fuel line providing communication between said working space and said pressure chamber is a passage formed in said fuel injector housing.

6. A system according to claim 5, wherein said annular space around said nozzle needle is formed between said nozzle opening and said pressure chamber directly adjacent said nozzle opening.

* * * * *